United States Patent [19]

Bowman et al.

[11] 3,977,665

[45] Aug. 31, 1976

[54] CONTINUOUS BOOK-MAKING SYSTEM

[75] Inventors: Kenneth Albert Bowman; Royston Gilbert Breddy; Royston John West, all of Bristol, England

[73] Assignee: Strachan & Henshaw Limited, Bristol, England

[22] Filed: July 17, 1974

[21] Appl. No.: 489,443

[30] Foreign Application Priority Data

| | | |
|---|---|---|
| July 20, 1973 | United Kingdom | 34713/73 |
| Oct. 16, 1973 | United Kingdom | 48203/73 |
| Sept. 18, 1973 | United Kingdom | 43807/73 |
| Nov. 20, 1973 | United Kingdom | 53749/73 |

[52] U.S. Cl. ..... 270/4; 270/54

[51] Int. Cl.[2] ..... B41F 13/58

[58] Field of Search ..... 270/1–22, 270/37–38, 42–44, 54–56

[56] References Cited

UNITED STATES PATENTS

| | | | |
|---|---|---|---|
| 2,019,658 | 11/1935 | Crafts | 270/6 |
| 2,631,845 | 3/1953 | Zuckerman | 270/5 |
| 2,873,113 | 2/1959 | McWhorter | 270/55 |
| 3,525,516 | 8/1970 | Bushnell | 270/54 |
| 3,881,716 | 5/1975 | Bryson | 270/54 |

*Primary Examiner*—J. Reed Fisher
*Assistant Examiner*—A. Heinz
*Attorney, Agent, or Firm*—Behr & Woodbridge

[57] ABSTRACT

An in-line book making system produces sets of signatures ready for "come and go" binding. Webs printing in respective presses are slit collated and folded into signatures which are fed in succession to two collecting pockets, one pocket receiving a batch of signatures totalling all the pages of the book and then the other pocket receiving a similar batch. The batches are fed in identical orientations from the respective pockets to respective conveyors, which cause a relative rotation of the batches through 180°. The two batches are then brought together, when they together contain all the pages for two books in a disposition which can be bound in come and go binding and then cut apart.

The signatures may be made by a former-folding process.

The conveyor system may additionally be operable to eliminate the 180° relative rotation, in case simple binding is desired.

9 Claims, 16 Drawing Figures

80
81
82
40
41
42
43
44
45
46
47
48
49
40'
41'
42'
43
44

CONTINUOUS BOOK-MAKING SYSTEM

FIELD OF THE INVENTION

This invention relates to book making and is concerned with providing for in-line or continuous book making that is to say the production of a book in a continuous process starting from the printing of the web, at least as far as the compilation of a set of signatures ready for binding together to form one or more books.

BACKGROUND OF THE INVENTION

Ordinary book making systems are essentially discontinuous processes. Books are prepared by printing the requisite numbers of each signature of the book separately. There is thus made a batch of a given number of a first signature which is then stored in a stack or on a pallet or the like and then the preparation of a batch of an equal number of a second signature is carried out, the batch of second signatures is then stored, and so on. When the time came for binding, one of each signature is taken in turn from the respective stored batches so that a set of signatures is arrived at and the set is bound together. This is clearly an uneconomical process involving much storage and handling and several propsals have been made whereby some of the worst disadvantages of the process could be overcome.

In U.S. Pat. specification No. 2631845 for example, the inventor shows how from a single web he may in a single operation produce four different signatures which are taken to four different delivery stations from his machine. He has thus streamlined the above-mentioned process in that in a single printing operation he produces a multiple number of signatures, but he still has to separately store them and then re-collate them later in sets for binding. Thus, this is not a continuous process since it is interrupted at the stage when the signatures have been produced and must then be stored or otherwise handled before being collated for binding.

In U.S. Pat. specification No. 2613077 there is disclosed a genuinely in-line or continuous process wherein dissimilar signatures are printed sequentially on a web of paper which is then folded and cut into signatures and the successively different signatures are then fed one after the other into pockets in a reception conveyor so that each pocket contains a set of signatures making up the whole book. These sets having been gathered up in the pockets are then deposited on a delivery conveyor which takes them away. This disclosure also discusses the possibility of signatures in this process being formed by "former-folding" i.e. the method of operation in which the spine fold of the signature is parallel to the longitudinal direction of the web from which the signature was formed rather than transverse to the longitudinal direction as in ordinary folding.

However, the conveyor pocket arrangement here is such that it is impossible to use this machine for the continuous printing of books which are to be bound "come and go".

Another attempt has been made to provide a continuous printing process and this is shown in United Kingdom Pat. No. 1215194. Here however the solution was in effect to print the whole book at once by means of a greatly elongate printing plate in the form of a belt. While this has advantages in some particular applications, there is a serious lack of adaptability in the sense that the only printing process which can be used is one which is available to that flexible belt, in that the machine as disclosed is inherently restricted to printing a single web, and is not adaptable to two-on printing for the purpose of "come and go" binding.

"Come and go" binding is per se known and there is an explanation of one form of it in the said U.S. Pat. No. 2631845 with particular reference to FIGS. 5 to 11. The process involves preparing pairs of similar signatures produced from a printing plate arranged so that it prints two distinct parts of a book on different sides of a longitudinal dividing line of the signatures and set in opposite directions. Then, for binding, the pairs of signatures (or pairs of batches of signatures) are placed face to face and bound together. They are then cut half way along their major edges and the product is two complete books. The advantages of this mode of working is to permit a doubled output per unit time from the binder and less production time lost in setting up the press without however using duplicate plates. However, the process has never yet been made continuous.

Nor would the continuous processes of the prior art discussed above be adapted to "come and go" binding at least without total duplication of all the parts of the machine up to the final deliverey conveyor, something which is completely uneconomic and unrealistic, not only from the point of view of duplication of the machinery involved but also from the point of view of double plate-making since identical sets of signatures will have to be prepared in all of the parts of these supposed machines.

SUMMARY OF THE INVENTION

The present invention provides a system for continuous book making which involves the preparation of signatures printed two-on for come and go binding. This is achieved with only a single printing of each signature i.e. a signature containing certain pages can have been printed by one set of plates and one set of plates only. Thus there is no double plate-making. This is achieved by arranging the printing material on the plates and constructing the machine such that there are at least two collecting pockets each operable to collect sequentially a plurality of dissimilar signatures totalling in their pages the number of pages printed in a single operation of a printing press, distributing the signatures to the two pockets and depositing from the pockets onto a conveyor means to take the signatures from the respective pockets to a bindery, there being means for causing relative rotation of the signatures respectively from the two pockets through 180°. This rotation may be in a horizontal plane, about a vertical axis, and be followed by a further relative rotation of 180° about a horizontal axis, about similar edges (normally the spines). In this way the product of a single press (or a single set of presses) is first divided into two and then recollated but with a rotation through 180° being imparted as between the divided product before it is recollated. Thus, the products of the press may be signatures printed two-on and the product of the system is sets of signatures printed two-on and collated ready for come and go binding in an entirely continuous manner from printing to collating.

In another general statement the invention provides a continuous book production line including one or more web printing presses each printing the material for a plurality of signatures, a reel stand for a web input to each press, a slitter dividing the web output of each press into ribbons and means for superimposing the ribbons of one or all of the presses, a cutter transversely cutting the superimposed ribbons into signature lengths and a folder producing one or more folds to produce the folds of the signatures, a plurality of collating pockets and means operative to direct a plurality of signatures sequentially first to one of the plurality of collecting pockets and then to another of the plurality of collecting pockets, the pages in each plurality of signatures totalling the number of pages in the book to be produced and being printed two-on in the signatures, the pluralities of signatures being deposited from each of the said pockets respectively to a conveyor assembly and means in the conveyor assembly imposing upon the pockets a relative 180° rotation as between the pockets from one of the plurality of pockets and the signatures from the other of the plurality of pockets, whereby signatures from each of the plurality of pockets, all deriving from one press or one plurality of presses from which the output is treated in common, provide a continuous output of sets of pluralities of signatures placed face to face in a come and go pattern ready for binding.

Although the first-mentioned rotation through 180° is preferably achieved by rotation of the signatures from one of the pockets only while the other remains unchanged in its orientation it is possible that both pluralities of signatures may be rotated e.g. through 90° each before being re-collated.

In a modified form of the invention, the conveyor assembly is operable in either of two modes, in one of which the said 180° relative rotation is provided and in the other of which it is not provided whereby the system may be used optionally for simple binding.

In a further modification, the folders may be "former-folders" i.e. folders disposed such that the spine fold of a signature is in the longitudinal direction of the printed web.

There may additionally be a provision for the insertion of additional signatures (for example containing less than the standard number of pages or for example printed on different grade of paper or by a different printing process) into the assembled pluralities of signatures on the conveyor assembly.

Figure 1:
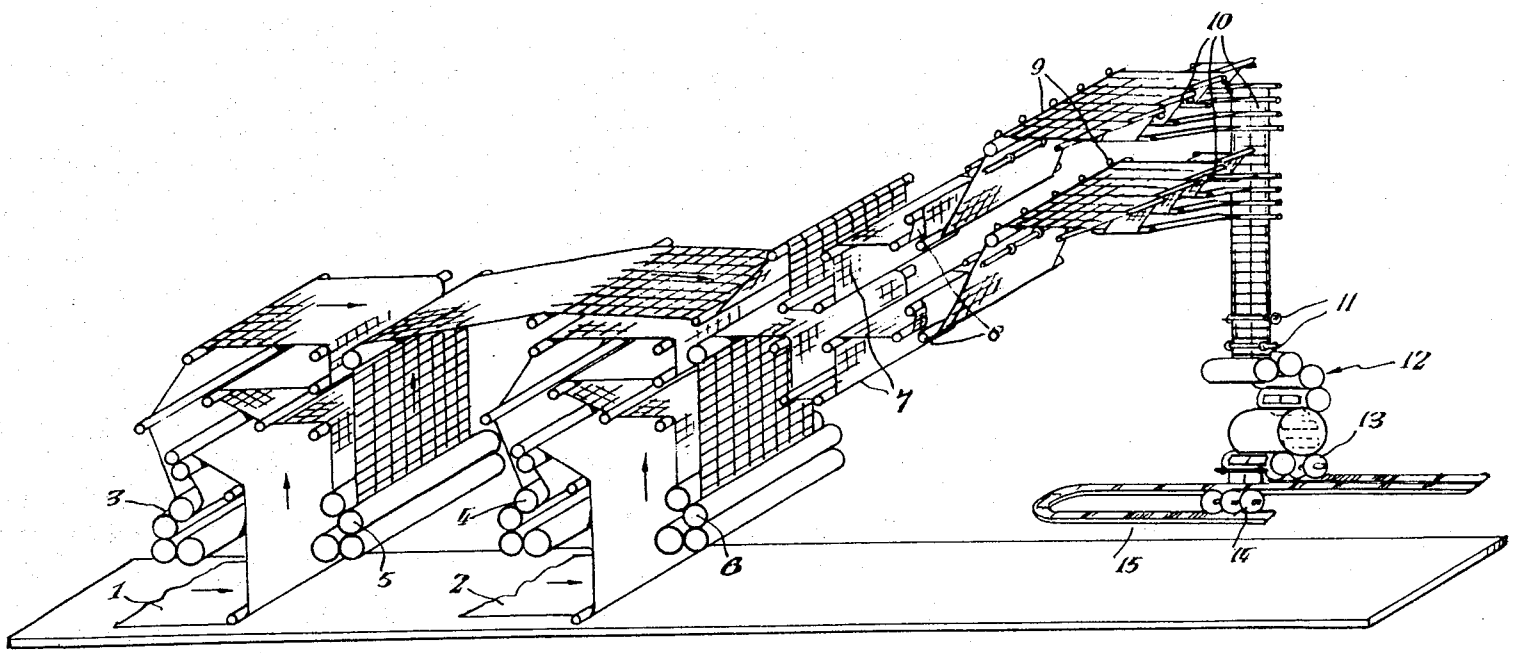
FIG. 1 is a perspective and diagrammatic general layout of one continuous book making system embodying the invention.

In the present embodiment we show an in-line book making system which produces books continuously from the output of two presses. The system is applicable however to the use of one two or more presses up to the capacity of the paper handling portions of the system.

In the present embodiment there are two web inputs at 1 and 2 to the respective presses which are printed at 3 and 4 respectively on one face of the web and at 5 and 6 respectively on the other face of the respective webs. The printed webs are then passed through guide roll arrangements 7 and tension roll arrangements 8 to slitters 9 which divide them each to a plurality of ribbons, in this case four ribbons. These are then turned in turner bar assemblies 10 in such a way that four ribbons from each web are collated superimposed with each other and the two sets of four ribbons are also collated superimposed with each other. When the collated ribbons pass between draw rollers 11 therefore there are in the present example eight thickness of ribbon which pass to a folding and cutting mechanism generally indicated at 12. This has the function of delivering folded signatures, cut from the ribbons, sequentially to one collecting pocket 13 and then to another collecting pocket 14. The collecting pockets 13 and 14 deliver the signatures which they receive to a conveyor assembly 15 which takes them to a bindary.

The matter to be printed is arranged on the plates of the presses in such a way that each ribbon contains material printed two-on across the width of the ribbon and so that the collated lot of eight ribbons as they enter into the folding machine bear on them in longitudinal sequence pages which total the number of pages to be printed in the book that is to say the pattern of printed material on the ribbons repeats only when, considering all the ribbons together, all the pages of the book have passed a given point in the travel of the collated set of ribbons. As will be seen in the later description a batch of signatures resulting from the folding and cutting of the ribbons during one repeat of the pattern and therefore containing all the pages of the book is first delivered to one of the two pockets 13 and 14 and then a batch of signatures, equally totalling all the pages of the book, and resulting from the cutting and folding of the ribbons during the next repeat of the pattern, is delivered to the other of the pockets 13 or 14. Each batch of signatures is printed two-on and so normally each have half the number of pages in the book facing one way and the other half of the number of pages facing the other way. Therefore to achieve continuity in this style of printing and binding the invention provides that the respective batches of signatures having been separated into the two pockets are then reunited but only after there has been a 180° change of relative orientation between the batches the change being produced automatically and in an in-line fashion. Thus, when they are so reunited there is produced a set of signatures having all of the pages of the book printed facing in one direction at one end of the signature and all of the pages of the book printed facing in the other direction at the other end of the signature. The complete set can then be bound together in come and go binding and two complete books separated from each other by a cut at the half-way line of the length of the signature.

A more detailed explanation follows.

Figure 2:
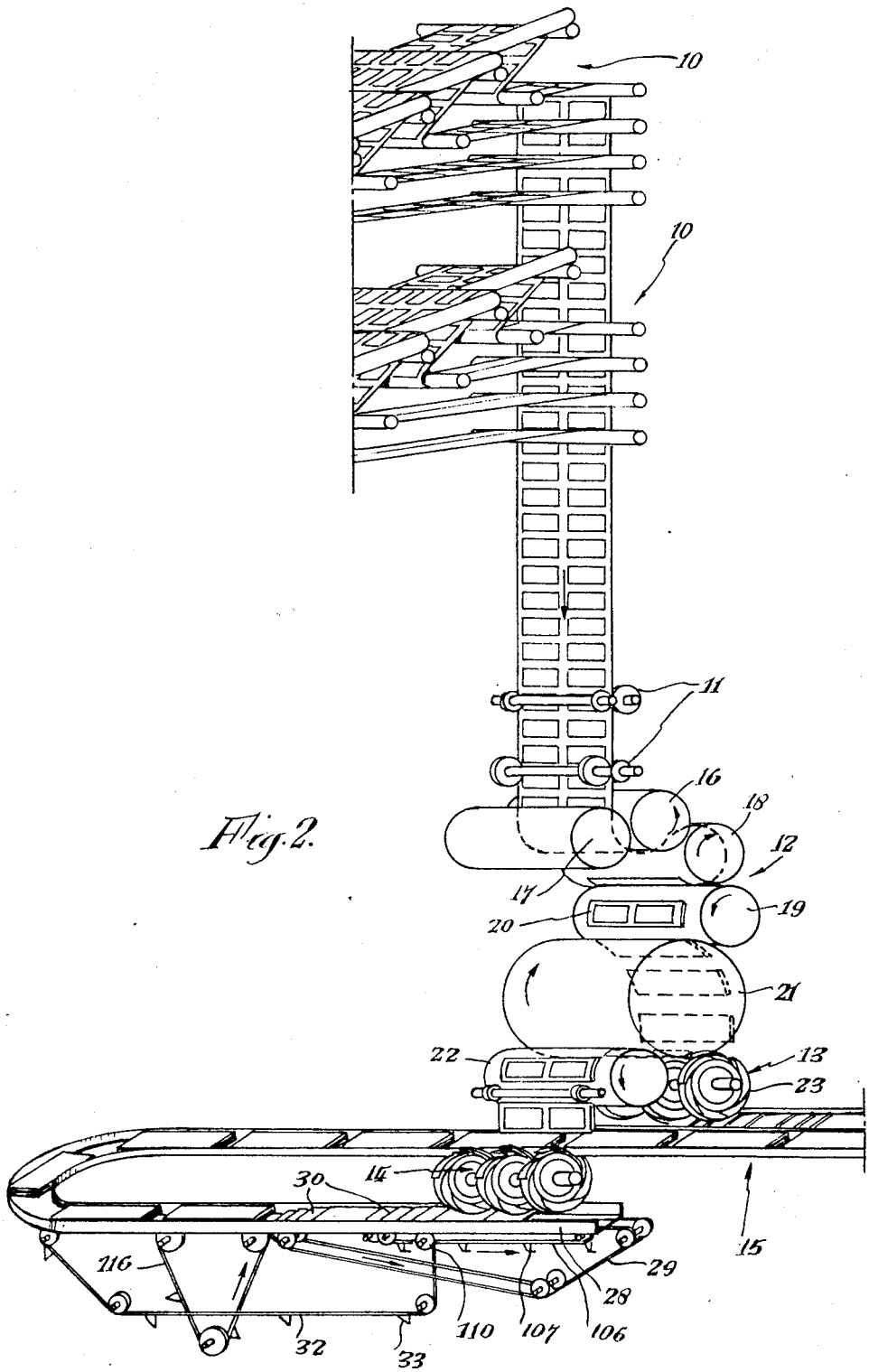
FIG. 2 is a perspective view on a larger scale of part of FIG. 1.

FIG. 2 shows the cutting and folding positions in more detail. After the collated ribbons have passed between draw rollers 11 they are cut to length by cutter cylinders 16, 17 and passed to folding cylinders 18 and 19 from which stage the completed signature such as 20, having in this example one fold, is transferred to a transfer cylinder 21 having leading edge clips which are operated to release signatures either to a first collecting pocket 13 or to a second transfer cylinder 22. From the second transfer cylinder they can be released to the second pocket 14. In the present example each of the folded signatures 20 will be 16 thickness of paper thick and will therefore carry two sets of 32 pages (one set at one end printed one way up and one set at the other end printed the other way up). If the book to be made is a 256 page book the periodicity of the pattern on the ribbons will be 8 pages long that is to say all the pages of the book will be comprised in four signatures such as 20, 128 of the pages (4 × 32) being at one end of the signatures printed one way and the other 128 being at the other end and printed the other way. In this example, then, the first transfer cylinder 21 and second transfer cylinder 22 are operated to deliver first four signatures such as 20 to the pocket 13 and then four signatures such as 20 to the pocket 14. Thus each pocket will receive signatures successively which contain all the pages of the book. It can be seen therefore that the continuous production of the printing press or presses has been divided between two different collecting pockets each receiving in turn the total number of pages of the book.

Each of the pockets 13 is made up of three discs mounted on a common rotating shaft and each disc having outwardly spiralling arms 23 in a manner known per se. Such pockets are also known in the art by various other names including "flyers" and "fans".

All of the plurality of signatures destined for one such pocket and making up in their pages all the pages of the book may be deposited within a single segment of the pocket i.e. within a single one of the spiralling arms but for high-speed operation usually individual signatures would be delivered successively to individual arms as the pockets rotate, these signatures then being stripped out successively onto the conveyor system which will now be described in more detail with more particular reference to FIGS. *3a* and *b*. FIG. *3b* is a continuation of FIG. *3a* on the lines X—X.

In FIG. *3a* the collecting pockets themselves are omitted but signatures are shown at 25 as if being transported in the pocket 13 and at 26 as if being transported in the pocket 14. Strippers 27 which are stationary on a trough frame 28 of the conveyor system interfinger between the discs of the pocket construction and arrest the leading edges of the signatures brought there by the revolving pockets. It can be seen from inspection of the geometry of the machine of FIG. 2 that the spine edges of the signatures are the leading edges in both of the pockets 13 and 14 so that the spine edges will be the ones which hit the strippers 27. Thus, when the signatures first are deposited on their respective conveyor means 29 they are oriented identically in space.

Figure 3B:
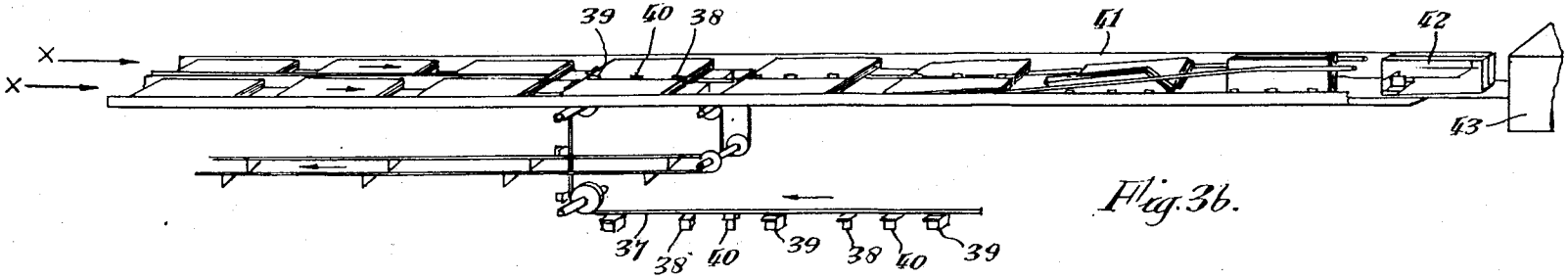
FIGS. 3*a* and *b* show in perspective the conveyor assembly to which signatures are delivered, FIG. 3*b* being a continuation of FIG. 3*a;*

Any form of conveying mechanism may be used and the batches of signatures totalling in their pages the number of pages of the book may be deposited in a stack on a conveyor which may be an indexing conveyor or a permanently moving conveyor. However for high speed operation as has been mentioned the signatures will preferably respectively occupy individual arms of the pockets and will be deposited individually on a continuously moving conveyor means. In the present embodiment these means are shown as parallel friction belts 29 to impose movement on the signatures, and guidance is given by the trough frame 28. Since these belts are continuously moving, signatures fall into shingled formation as indicated generally at 30, the shingled formations being separated by gaps representing the time during which there was no delivery to that particular conveyor i.e. a plurality of signatures was being delivered to the other pocket and to the other conveyor. Means are provided for assembling the shingled signatures into vertically compact stacks such as are shown at 31 and these means will be more fully described later. Movement of the stacked batches of signatures once they have passed off the friction belts 29 is taken up by pusher elements 33 on respective chains or belts 32. In the conveyor means which leads from the pocket 14 there is in the trough frame 28 a U-turn at 34 round which the stacked batches of signatures are driven by a rotating spider arm 35 until their drive is again taken up by pushers on chain or belt 36. The U-bend 34 causes the signatures from the pocket 14 to undergo a rotation of 180° about an axis normal to their faces as they pass from under that pocket to adjacent the pocket 13. By the time stacks 31 have been formed from the signatures originating from pocket 13 registration of the pushers means that parallel stacks 31 are in register, which derived respectively from the different pockets but which have changed in relative orientation between the two by 180° so that it is now the spine edges of the batches which are nearest to each other as they progress parallel to each other under the influence of pushers 33 and 36. As is seen in FIG. *3b* during the straight run of the trough frame 28 pushing is taken over by a pusher conveyor 37 which is common to the two batches of signatures. In succession on an endless chain or belt are sets of vertical separators 38 and 40, and trailing edge pusher shoes 39. A trailing edge pusher shoe 39 takes over drive of the pairs of batches 31 of signatures as they are brought into a plow construction 41 which brings the pairs of signatures so that they are disposed vertically and face to face as at 42, with both spine edges lowermost. At 42 therefore one has completely assembled as a result of a process continuous and in-line from the printing, a block of paper which comprises two complete books printed two-on and which is made up of batches of signatures deriving from pockets 13 and 14 respectively. It is completely ready for come and go binding. This may also follow as Part of the completely continuous process in a bindery completely diagrammatically represented as 43 FIG. 3b and which may be fed by conveyor 37. In the bindery cover sheets and the like will be wrapped around the block 42 and after binding the two books will be separated by a cut at the half length of the block 42.

It can be seen that the process is completely flexible in the sense that any printing process may be used in the printing presses and indeed one printing press may use a process different from the other.

Figure 3A:
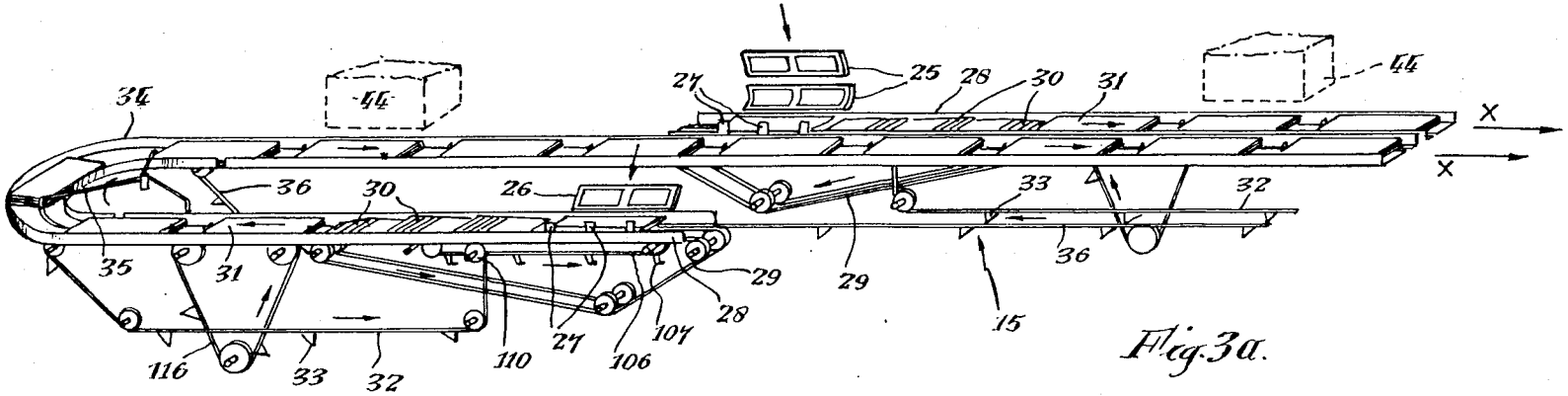

Any suitable process of binding may be used. For further flexibility it is envisaged that inserters may be provided at positions such as those indicated at 44 FIG. 3*a*, from which may be fed signatures, part signatures or even single pages onto the stacked batches 31 or to some determined position between the signatures making up those batches. By this means there may be inserted in the books pages for example of photogravure, all as part of the continuous process.

Figure 4A:
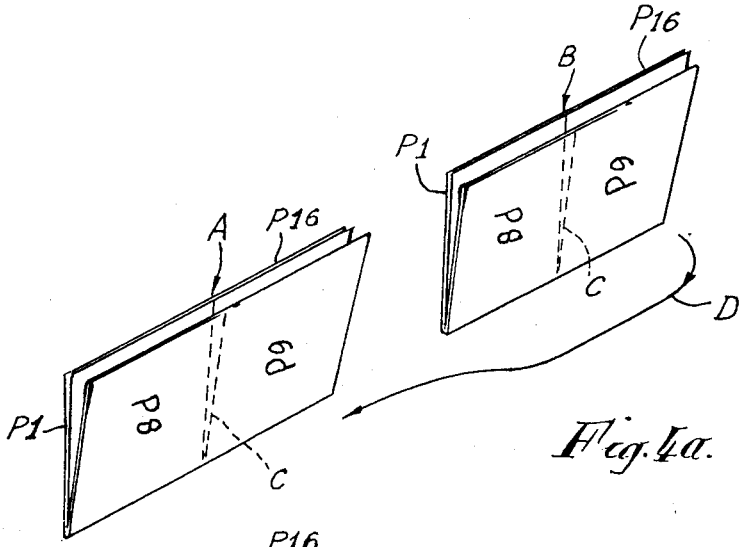
FIGS. 4*a* and *b* are diagrammatic drawings illustrating the principles of two-on printing for come and go binding.
Figure 4B:
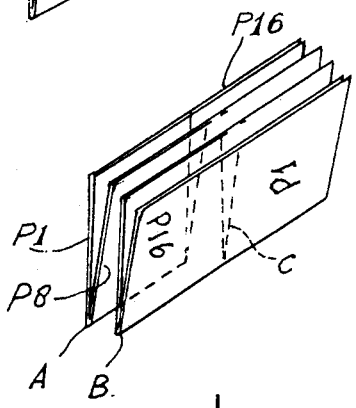

FIG. 4 shows diagrammatically the operations involved in printing two-on for come and go binding. FIG. 4*a* shows two identical signatures here called A and B. Each is shown divided in their longitudinal direction of the web by a dotted line C. On signature A one side of the line C pages 1 to 8 are printed one way up while on the other end pages 9 to 16 are printed the other way up, the directions being indicated by the legends "P8", and "P9". If one of these two signatures is turned through 180° as indicated by the arrow D FIG. 4*a* and the two are placed face to face as shown in FIG. 4*b* it can be seen that a complete book of 16 pages is obtained on each side of the median line C, the books being printed different ways up on the signatures which, after binding are separated by a cut along the line C into two separate books.

Figure 5:
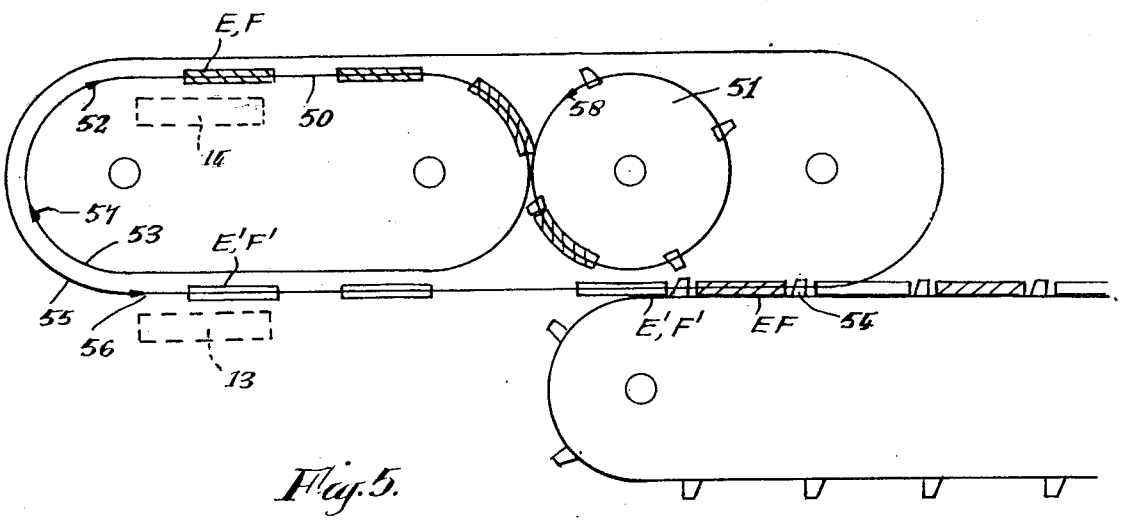
FIG. 5 shows in diagrammatic plan view an alternative conveyor arrangement, the conveyor system which may be operated either for come and go or for simple binding.

FIG. 5 shows how the principles illustrated previously can be applied in an embodiment having a conveyor system which permits both come and go binding with two-on printing and simple binding. The latter has however an increased unit capacity compared to that which would otherwise be available, due to the division of the presses into two pockets. Here a conveyor 50 fed from the pocket 14 receives batches of signatures containing material EF on their respective halves. This conveyor 50 is operable in either sense of rotation. Conveyor 55, fed from pocket 13 is operable only in the sense of rotation indicated by arrow 56. If conveyor 50 is operated in the sense of arrow 57 then signatures having material EF are brought from pocket 14 to adjacent the pocket 13 while undergoing a 180° turn around the bend 53 of the conveyor 50 and are then driven in common with signatures having material E′ F′ from pocket 13 as in the manner generally previously described. However for the purpose of producing books with say half the total number of pages. i.e. when the material E is identical to material F, and that of E′ to F′ then the conveyor 50 is operated in the sense of the arrow 52 and a transfer wheel 51 is operated in the sense of the arrow 58 so that signatures from pocket 14 are transferred without making a 180° turn relative to those from pocket 13 and are delivered alternatively with signature batches from pocket 13 to pushers 54 of a conveyor which takes them to the bindery. The input to the bindery then is a succession of signatures printed two-on but for simple binding.

Figure 9:
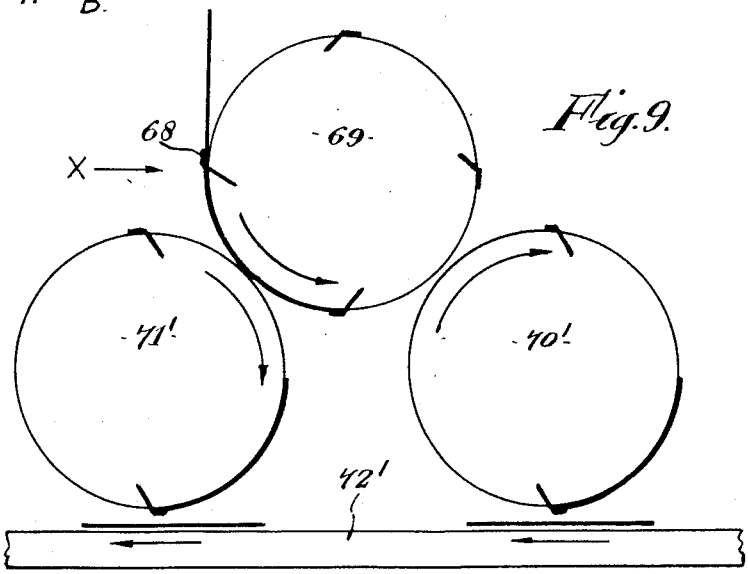
FIG. 9 shows an alternative mode of operation of the embodiment of FIG. 6.
Figure 6:
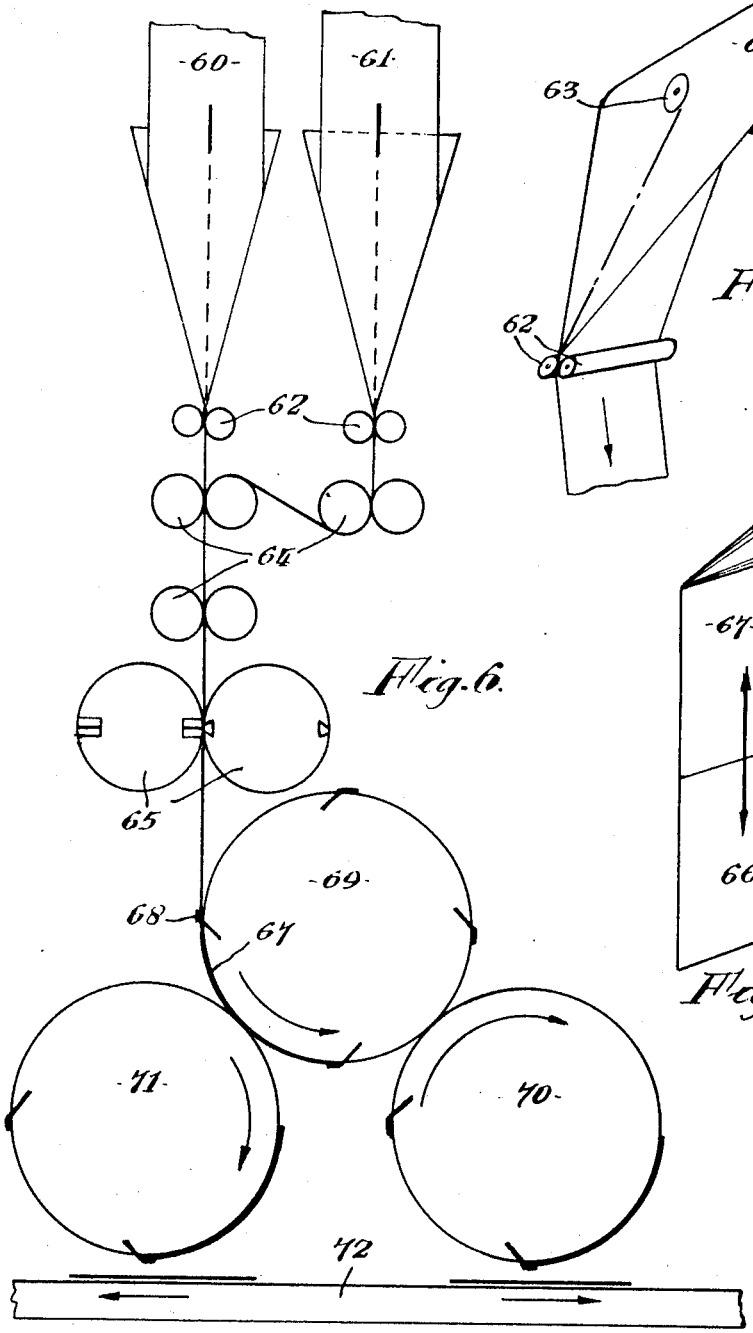
FIG. 6 is a partial side view of a former-folding embodiment of the invention.
Figure 7:
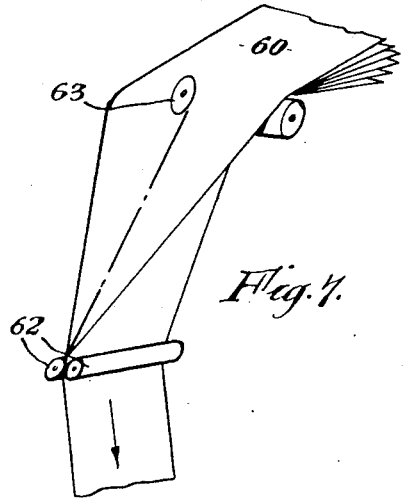
FIG. 7 is a perspective view of part of this embodiment.
Figure 8:
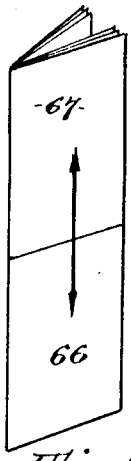
FIG. 8 shows a former-folded signature.
Figures 10, 11:
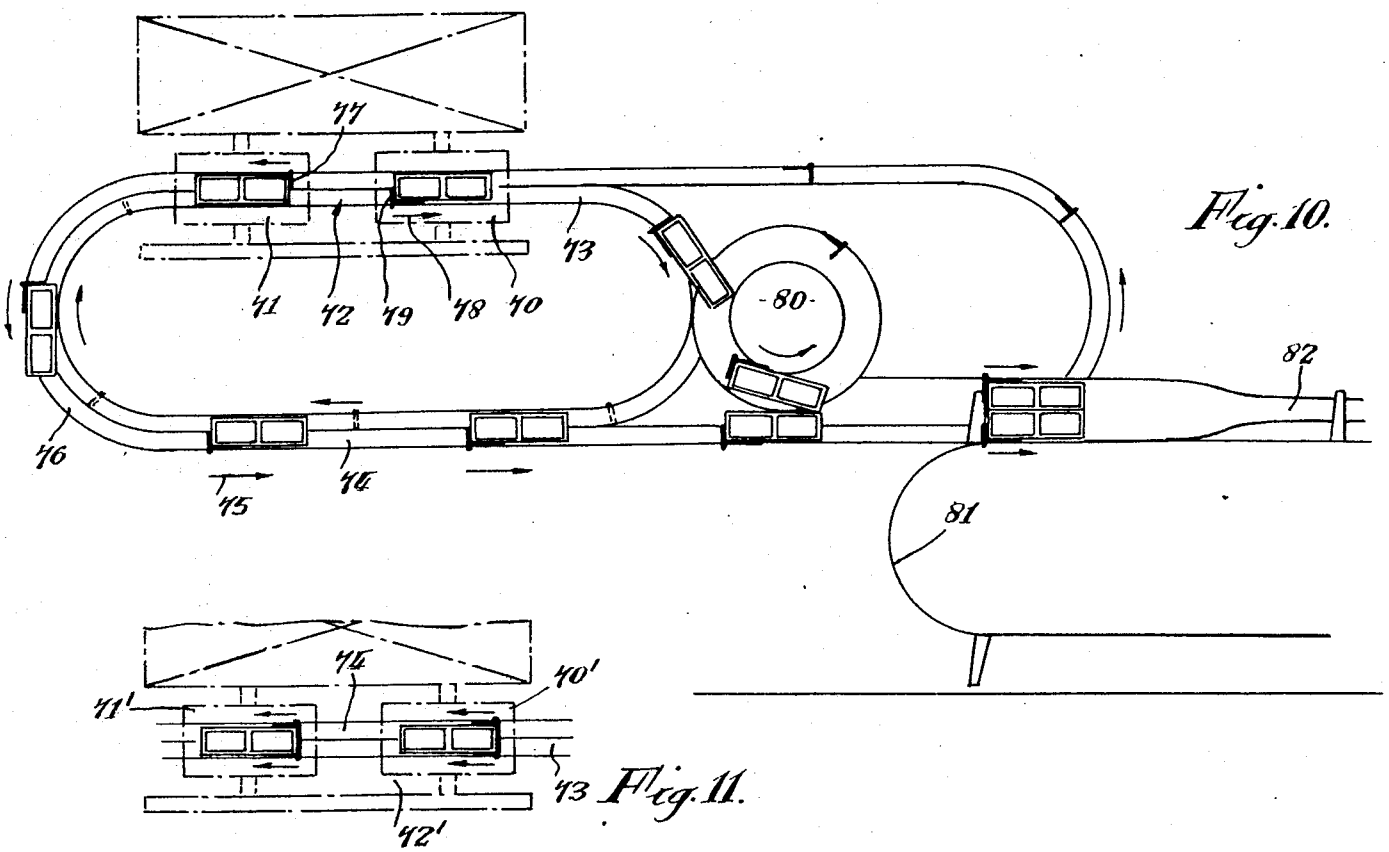
FIG. 10 shows in plan view a conveyor system of the embodiment of FIG. 6.
FIG. 11 shows in plan view part of the conveyor system of FIG. 10 operating in the alternative mode referred to in FIG. 9.

FIG. 6 will show how the principles of the invention are applicable equally to former-fold machines and systems. A "former-fold" machine is one in which the folding which will form the spine of the signature is executed in the longitudinal direction of the web as distinct from normal folding where the fold is transverse to the longitudinal direction of the web. FIGS. 6 and 7 show how collated ribbons 60, 61 from respective presses are folded by folder rolls 62 in known fashion, and may optionally be slit at 63, and are then, after folding, collated together through guide roller system 64 to a cutter pair 65 which severs lengths corresponding to two page lengths as illustrated in FIG. 8, where the double headed arrow 66 represents the direction of longitudinal run of the web which can be seen is parallel to the spine fold 67. Signatures thus prepared are taken by leading edge grippers 68 on transfer cylinder 69 and delivered in batches as previously described by transfer cylinders or pockets 70, 71 to a conveyor system diagrammatically represented in this drawing at 72. The direction of movement in the conveyor system 72 may be as in this drawing or as in FIG. 9. The conveyor system which may be used here is shown in FIG. 10. Because of the different manner of making the signatures and of distributing them the delivery systems 70, 71 deliver the signatures collinearly. In a manner generally analogous to that described with reference to FIG. 5 a double conveyor system 72 has one conveyor means 73 which is drivable in either direction and act on signatures from cylinder 70 whereas the other conveyor means 74 is drivable in only one direction indicated by arrow 75 and acts on cylinders delivered from cylinder 71. It can be seen that in this case conveyor 74 has the 180° turn provided, by U-bend 76. All signatures engaged by the pushers 77 on this conveyor will therefore undergo a 180° change in orientation whereas if the conveyor 73 is operated in the sense of the arrow 78, signatures from cylinder 70 engaged by its pushers will move to be transferred by transfer wheel 80 to lie parallel to signatures from cylinder 71 without those from pocket 70 having undergone any change in orientation. Then, when the batches of signatures lying side by side are taken up in common by pusher conveyor 81 and are plowed together at 82 as previously described with reference to FIG. 3 one has collated signatures ready for come and go binding. For simple binding however then the signatures are not printed for come and go binding, both conveyors 73, 74 are operated in the same sense as seen in FIGS. 11 and 9 and so both sets of signatures are taken round the 180° U-bend 76 and do not suffer any relative change in their position.

We now describe the means employed when it is desired to convert a shingled plurality of signatures making up a batch 30 to a vertically compact stack 31. The reception conveyor 29 has a horizontal run which passes beneath the output of one of the collecting pockets 13 and 14 described previously. Only one stacking arrangement will be described; the other is identical. Folded book signatures are deposited in succession on the continuously moving conveyor 29 so that they adopt a shingled formation 30.

Because of the arrangements of the folding machine the signatures will be delivered in batches, with empty pockets between the batches, thus the shingled array 30 will consist of a plurality, say four, signatures at a comparatively narrow stagger (for example three centimeters between successive front edges) followed by a gap between the leading edge of the fourth member of that batch and the leading edge of the first member of the successing batch equal to five such spacings i.e. approximately 15 centimeters. An endless belt or chain 106 has on it hook elements 107 which may be brought around by travel of the chain 106 so that the hook is lowered over the trailing edge of the last member of each batch at the same time as that last member is being deposited from the collecting pocket (FIG. 14); the hook passes over the trailing edge of the blade 105 and lowers as the blade rotates away sideways. Other means may be used to entrap the trailing edge of the last member of a batch to prevent it shingling irregularly. An example of such means is a wheel lowered onto the said trailing edge to push it down onto the conveyor belt, which may permit higher speeds of operation. The chain 106 is adapted to travel at the same speed as the reception conveyor 29.

At 32 there is provided a belt or chain, in this example a chain, bearing pushers 33. If the conveyor 29 and the hook chain 106 are moving at a speed relative to the rate of delivery of the pocket 14 so that there is say 24 centimeters between leading edges of the first members of the successive batches then the chain 32 will be moved at such a speed that there would have been approximately 50 centimeters i.e. it moves rather more than twice the linear speed. The pushers 33, which also have a separating function, are provided preferably only at one or both lateral edges of the signatures (and when at only one lateral edge, it is preferably the spine edge) and they are synchronised with the hook member 107 so that as successive pushers 33 travel in a run of the chain 32 between two sprockets 110, 111 they rise through the line of the conveyor 29 at a position behind the trailing edge of the last member of a given batch of signatures but well in front of the trailing edge of the leading member of the next batch so that they are under that next batch. These pushers are provided under one lateral edge only for preference because this has a tendency to bend the signatures 112 of the next batch, the one which is not being pushed by the pusher, about a longitudinal line (see FIG. 13) which holds them straight and strengthens them, and at the same time tending to throw them sideways against a stationary side wall 113 adjacent the belt 106 so that the members of the upper batch such as 112 have little tendency to be dragged forward by the pushers 33 which, it will be recalled, are travelling faster than the conveyor 29. However signatures in the batch preceding the pusher i.e. signatures such as 114, FIG. 3 will be pushed forward by it at that higher speed so that they tend to catch up with the leading member of the batch. At the same time however as each pusher 33 is rising through the line of the run of the conveyor 29 to cause this action to start, a retarder member 115 on a retarder chain 116 is also rising, an erected retarder member 115' being seen in FIG. 12. Each retarder member offers a face rearward in the direction of its motion which is perpendicular to the line of the run of the conveyor 29 and to the line of the main horizontal run 117 of the chain 108. The retarding chain 116 is travelling at a speed slower than that of the pushers, for example 40 centimeters per batch compared with the 24 of the conveyor 29 and the fifty of the chain 32. This means that as the pusher 32 moves it is tending to move up to the retarder 115 which has been erected in front of it and as it accelerates the signatures of each batch to its own speed it compiles them one directly above the other against the vertical face offered by the rear of the retarder. Whether the articles of the batch other than the leading one travel bodily in shingled formation under the influence of the push exerted on the rearmost one so that they strike the rear face of the retarder 115 successively starting from the bottom, or whether they are brought forward successively and singly from the rearmost will depend only on the frictional interaction between the articles in the batch. It is arranged that as soon as the distance between a given pusher 33 and retarder 115 is substantially the same as the length of the articles in each batch, the retarder (then at position 115') is retracted from in front of the batch as the chain 116 brings it round guide pulley 118 so that the whole of the batch, now stacked directly vertically one above the other, can be carried on at the speed of the pusher 33 and can be taken on by a further conveyor 37, possible to be accelerated by that further conveyor to higher speeds. This retraction of the retarder 115 is arranged with reference to the position of the guide sprockets 118 and 118' which define the horizontal run of the retarding chain 116, the relative speed of that chain and of the pusher chain 108 and of the pitch spacing between the retarders 115 and between the pushers 33.

Figure 12:
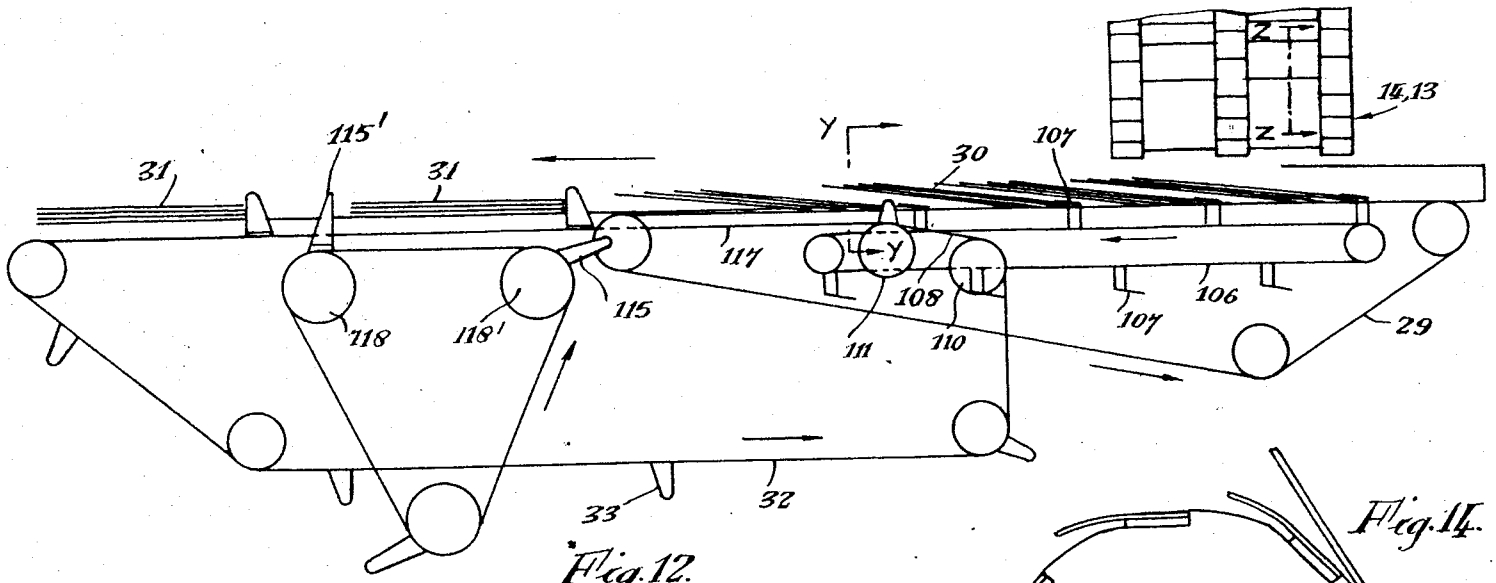
FIG. 12 shows in side elevation a stacking mechanism associated with the conveyor of the system.

If it is found that for a given run of articles the checking of the succeeding batch provided by the static wall 113, when the pusher 33 comes up beneath that succeeding batch, is insufficient then retarder means such as a retarder wheel to press lightly against the articles of the next succeeding batch may be provided in the region of the section line Y of FIG. 12.

In book-making systems there is particular advantage in providing the hook member 107 since these ensure that each batch of, say, four signatures is accurately and positively separated from the next one so that it can be quite certain that each stacked batch of four signatures contains the material of a given number of pages of a book in a given succession.

Figure 14:
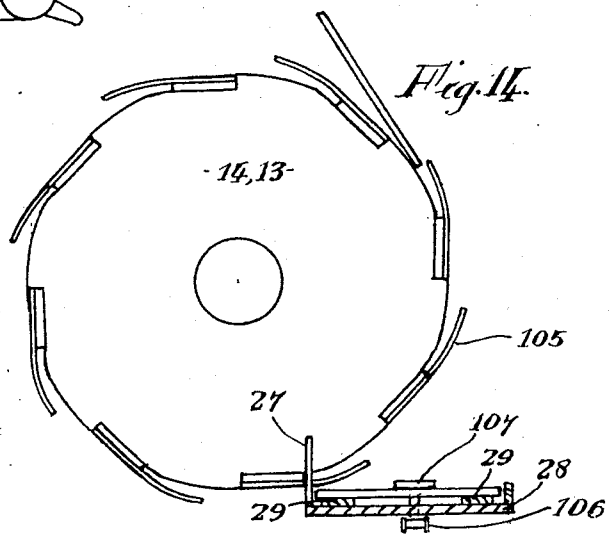
FIG. 14 is a section on the line Z—Z FIG. 12.
Figure 13:
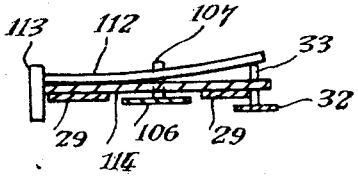
FIG. 13 is a section on the line Y—Y FIG. 12.

The stacking mechanism and method described with reference to FIGS. 12 to 14, though novel, forms in itself no part of the present invention. It is described and claimed in co-pending Pat. application No. 489442 of Alsop, assigned to the assignee of the present application and filed on the same day as the present application.

We claim:

1. A book making system for making a book with a predetermined number of pages, said system including at least one printing press, a slitter and a cutting and folding means, said system further including:

a feed means for continuously feeding material printed by said printing press to said slitter for slitting and to said cutting and folding means for cutting and folding, said cutting and folding means thereby producing successive identical batches of signatures each batch including all of the predetermined number of pages of said book half of said pages in one orientation and half of said pages in an opposite orientation, each batch further including a face portion and a back portion;

distributor means for dividing said batches of signatures into two separate streams;

conveyor means for receiving said two separate streams of batches from said distributor means, said conveyor means including means for imposing a rotation of 180° on said batches of one stream relative to the batches in the other stream; and, said conveyor means further including collating means for paring a batch of signatures from one stream with a batch of signatures from the other stream thereby forming a set of batches with the face of the batch from one stream facing the back of the batch from the other stream; whereby the set just formed is prepared for come-and-go binding.

2. The book making system of claim 1 further including a bindery; and, wherein said conveyor means extends to said bindery in order to bring collated sets of signatures thereto.

3. The book making system of Claim 1 wherein said folding means comprises a transverse folder; and, said distributor means distributes said batches of signatures alternatingly to two pockets positioned spaced apart and parallel with their axis of rotation parallel to a direction of travel of said conveyor means, said conveyor means including two conveyor tracks respectively to receive signatures from said respective pockets, said one track including a 180° bend and extending from a first region comprising a reception run adjacent one pocket to a second region comprising a run parallel to and adjacent the other of said tracks at a position where the said other track has a reception run adjacent to the other of said two pockets, the 180° bend being between the two regions.

4. A book making system as claimed in claim 3 wherein a conveyor of the said one of the said conveyor tracks has a reversible direction of travel, and includes a first 90° bend and a second, reverse, 90° bend operative when the said conveyor is travelling in its reverse direction, whereby signatures may be transferred from its reception run to its parallel run without the said 180° rotation.

5. A book making system as claim in claim 3 which has a plurality of printing presses, plates on the printing presses all being different and their output being brought in common to the cutting and folding mechanism.

6. A book making system as claimed in claim 5 wherein the pockets deliver the signatures to the conveyor means in identical attitudes, lying with their major planes horizontal and their spine edges in one direction, the 180° turn taking place about a vertical axis perpendicular to the said major planes whereby, in the said parallel run of the one track and the reception run of the other the spines of the batches are directed towards each other, and the said runs including a plow means for plowing the batches on the respective tracks together and rotating them relatively through 180° about a horizontal axis to collate a pair of batches together into a set of signatures ready for come and go binding.

7. A book making system as claimed in claim 6 wherein the 180° relative rotation about a horizontal axis is achieved by causing each batch to rotate 90° about its spine edge, in respectively opposite senses.

8. The book making system of claim 1 wherein said folding means is a former-folder; and, said distributor means is operable to distribute said batches of signatures alternately to two pockets positioned spaced apart and parallel with their axes or rotation at right angles to a direction of travel of said conveyor means, said conveyor means including two conveyor tracks respectively to receive signatures from said respective pockets, one of said tracks including a 180° bend and extending from a first region comprising a reception run adjacent one pocket to a second region comprising a run parallel to and adjacent to the other of said tracks at a portion of said other track where said other track is parallel but spaced from a reception run adjacent the other of the said two pockets, said 180° bend being between the two regions, the said other track including a first 90° bend and a second, reverse, 90° bend between its reception run and the said parallel portion.

9. A continuous method of making a book comprising the steps of:

printing a substantially continuous piece of paper;

feeding said continuous piece of printed paper to a slitter for slitting said piece of paper;

cutting and folding said slit piece of paper thereby producing identical batches of signatures, each batch including all of the predetermined pages necessary to form a single book in a standard orientation, each batch further including a face and a back thereto;

dividing said batches of signatures thus produced into two and only two separate streams of batches, said batches in said two streams being identical to each other;

rotating said batches of one stream 180° relative to the batches in the other stream; and collating one batch from one stream of batches with one batch from the other stream of batches in a face-to-back relationship with each other, thereby forming sets, each set including twice the predetermined number of pages found in any individual book, whereby the set thus formed in prepared for come-and-go binding.

* * * * *